United States Patent [19]

Romey et al.

[11] Patent Number: 4,761,959

[45] Date of Patent: Aug. 9, 1988

[54] ADJUSTABLE NON-PILOTED AIR BLAST FUEL NOZZLE

[75] Inventors: Russell P. Romey; Lonny R. Greer, both of Jacksonville, Fla.

[73] Assignee: Allied-Signal Inc., Morristown, N.J.

[21] Appl. No.: 20,304

[22] Filed: Mar. 2, 1987

[51] Int. Cl.[4] ..... F02C 1/00; B05B 15/08

[52] U.S. Cl. ..... 60/740; 239/587; 239/416.5

[58] Field of Search ..... 60/740, 741, 743, 747, 60/749, 748; 239/587, 423, 424, 416.5, 403; 431/187, 354

[56] References Cited

U.S. PATENT DOCUMENTS

| | | | |
|---|---|---|---|
| 846,990 | 3/1907 | Fitzsimmons | 239/587 |
| 1,255,745 | 2/1918 | Henricson | 239/587 |
| 1,676,564 | 7/1928 | Lausen | 239/587 |
| 1,980,636 | 11/1934 | Roumillat | 239/587 |
| 2,500,787 | 3/1950 | Lelgemann | 431/287 |
| 2,670,789 | 3/1954 | Dietrich | 239/587 |
| 2,762,656 | 9/1956 | Fraser | 60/740 |
| 2,895,435 | 7/1959 | Bogot et al. | 239/587 |
| 3,421,702 | 1/1969 | O'Brien | 239/587 |
| 4,139,157 | 2/1979 | Simmons | 239/400 |
| 4,229,944 | 10/1980 | Weiler | 60/740 |
| 4,362,022 | 12/1982 | Faucher et al. | 60/742 |
| 4,418,543 | 12/1983 | Faucher et al. | 60/742 |
| 4,604,048 | 8/1986 | Schwartz et al. | 431/187 |

*Primary Examiner*—Louis J. Casaregola
*Assistant Examiner*—Timothy S. Thorpe
*Attorney, Agent, or Firm*—R. M. Trepp; B. L. Lamb

[57] ABSTRACT

A fuel nozzle for injecting atomized fuel into an air stream at an adjustable angle with respect to its longitudinal axis is described incorporating a support flange, a fuel supply tube, a nozzle tip body at the end of the fuel supply tube and a sheath between the support flange and the nozzle tip body for directing air to the nozzle tip body. A second sheath enclosing the first sheath is provided wherein each has a slot opening which may be positioned with respect to the support flange for admitting air into and where the size of the opening may be controlled by rotating the outer sheath with respect to the inner sheath to provide an adjustable overlap of the slot openings. The invention overcomes the problem of injecting fuel into the combustor of a jet engine at an angle which may be adjustable over a predetermined range to enhance combustion of the fuel. The invention further overcomes the problem of injecting or capturing a predetermined amount of compressor discharge air for subsequent flow to the nozzle tip.

16 Claims, 4 Drawing Sheets

ADJUSTABLE NON-PILOTED AIR BLAST FUEL NOZZLE

BACKGROUND OF THE INVENTION

1. Field of the Invention:

This invention relates to fuel nozzles for a jet engine and more particularly to an adjustable air blast nozzle to vary the air flow to the nozzle tip and to vary the fuel injection angle of atomized fuel as it exits the nozzle for burning in the engine combustor.

2. Description of the Prior Art:

In the prior art, a fuel manifold supplied fuel to a number of nozzles in the combustor of a jet engine. The nozzles normally were positioned generally symmetric about a center axis for generating a cone of atomized fuel which would be expelled from its nozzle tip. The nozzles were normally permanently mounted with the fuel manifold with the axis of symmetry of each nozzle parallel to one another with each nozzle generally spaced on a circular pattern at the upstream end of the combustor.

The design of a nozzle tip for providing atomized fuel has been the subject of extensive engineering design to provide complete burning of fuel during idling as well as under load. The nozzle tip, however, is positioned in fixed relationship with the nozzle body for expelling atomized fuel in a cone along the axis of symmetry of the nozzle and nozzle tip.

In U.S. Pat. No. 4,418,543, which issued on Dec. 6, 1983 to J. E. Faucher et al. a dual orifice fuel nozzle for the combustor of a gas turbine engine is described. A portion of air from the compressor is admitted internally in the nozzle through swirl slots positioned around an axis of symmetry of the nozzle and imparts a tangential velocity to the air as it progresses into the combustion zone along with the fuel which also rotates in the same direction. An outer annular ring of air only is formed by a swirl cup which imparts a targential velocity to the air by swirl vanes also positioned around the axis of symmetry of the nozzle tip.

In U.S. Pat. No. 4,139,157, which issued on Feb. 13, 1979 to H. C. Simmons, an air-blast nozzle having a primary and secondary fuel supply is described in which the primary fuel is spread into a thin cylindrical or conical sheet to be atomized by high velocity and/or high pressure air. The secondary fuel is also spread into a coaxial cylinder or conical sheet, of greater thickness than the primary, which combines with the primary sheet before being acted upon by the atomized air. The combined primary and secondary sheet of fuel provide a single spray of constant shape at all operating conditions. Inner and outer air flows, which may be swirled, provide high velocity air streams which converge on the fuel sheet downstream to cause breakup of the sheet of fuel and the production of an atomized spray.

In U.S. Pat. No. 4,362,022, which issued on Dec. 7, 1982 to J. E. Faucher et al. a dual orifice nozzle is described with means for preventing coke buildup in the secondary fuel passage. The air pressure is increased in the secondary passage at times the secondary passage of the dual orifice is in the inoperative mode and the primary fuel passage is in the operative mode.

SUMMARY OF THE INVENTION

An apparatus is described for atomizing fuel and air and for injecting said fuel and air into an air stream at a first angle with respect to a first longitudinal axis wherein the first angle is adjustable over a predetermined angular range comprising a support flange for mechanically supporting a fuel supply tube and a first sheath, a nozzle tip spaced a predetermined distance from the support flange and having an air inlet and a fuel inlet and an outlet for expelling atomized fuel symmetrically outward from and along a second longitudinal axis of the nozzle tip, the fuel inlet of the nozzle tip being concentric with a pivot axis of the nozzle tip, the nozzle tip pivot axis positioned transverse to the first and second longitudinal axes, the fuel supply tube having a first end adjustably connected to the fuel inlet of the nozzle tip to supply fuel thereto and to support and hold the nozzle tip with its second longitudinal axis at the first angle, within the predetermined angular range, by positioning the nozzle tip around the pivot axis, the first longitudinal axis passing through the support flange and through the nozzle tip, an internal air cap having an outer surface with portions thereof conforming to the surface of a sphere surrounding the nozzle tip and attached thereto to direct air through the nozzle tip via the air inlet, the first sheath having a cylindrical shape concentric with the first longitudinal axis, having a slot opening for admitting air inside the sheath, the sheath extending a predetermined distance from the support flange, an external air cap having an inside surface with portions thereof conforming to the surface of a sphere and having a first opening for mating with an opening at the end of the sheath and a second opening in the external air cap where the inside surface has a portion thereof conforming to the surface of a sphere to permit the nozzle tip to expel atomized fuel through the second opening into the air stream at angle positions within a predetermined angular range about the pivot axis.

The invention further provides an apparatus for adjusting the positions and size of an air inlet to a fuel nozzle comprising a first sheath having a cylindrical outer surface of a first diameter concentric with a first axis, a second sheath having a cylindrical inner surface of a second diameter concentric with the first axis, the second diameter greater than the first diameter, a first opening formed in the first sheath, a second opening formed in the second sheath, first means, for example, a threaded joint for rotating the first and second sheaths together around the concentric axis to a first and second predetermined position, respectively, to position the first and second openings, second means, for example, a threaded joint for rotating the second sheath with respect to the first sheath to adjust the size of the opening formed by the overlap of the first and second openings, and a fuel nozzle positioned at the end of the first sheath to receive the air passing through the first and second overlapped openings.

It is an object of this invention to provide a nozzle tip which may be adjusted to vary the fuel injection angle of atomized fuel into the combustor of a jet engine.

It is a further object of this invention to vary the size and location of an opening in a nozzle upstream from a nozzle tip to optimize the air flow to the nozzle tip.

It is a further object of this invention to provide two concentric sheaths, each having an opening which may be rotated together to position the openings and rotated individually to adjust the size of the overlapped opening to admit air into a fuel nozzle.

It is a further object of this invention to provide a fuel supply tube supported by a support flange to a nozzle tip to support the nozzle tip, the fuel supply tube being bent or made to approach the nozzle tip aligned with a pivot axis to permit adjustment of the fuel injection angle by adjustment of the nozzle tip with the fuel supply tube at the nozzle tip fuel inlet which is concentric with the pivot axis.

It is a further object of this invention to provide a fuel supply tube supported by a support flange wherein the support flange and nozzle may be rotated about the center axis of the fuel supply tube to permit orientation of the support flange prior to securing the nozzle to a support member.

DESCRIPTION OF THE PREFERRED EMBODIMENT

Figure 1:
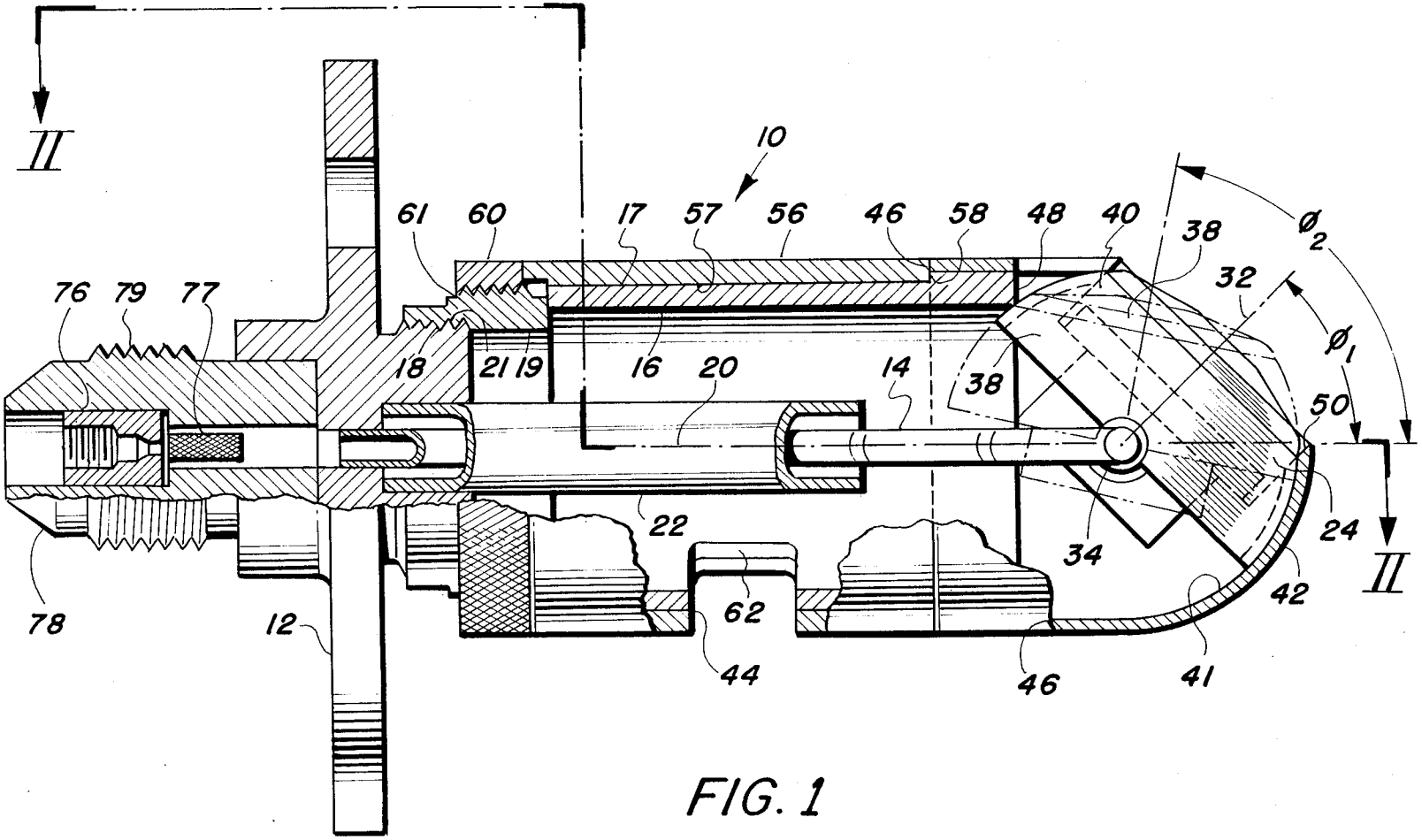
FIG. 1 is a perspective view with parts thereof in cross section of one embodiment of the invention.

Referring to FIG. 1, a fuel nozzle 10 is shown. A support flange 12 mechanically supports fuel tube 14, heat shield 22, fuel fitting 78 and nut 19. Nut 19 may have inside threads 18 to match corresponding threads 21 on flange 12 which are concentric with longitudinal axis 20. A first sheath 16 cylindrical in shape and concentric with longitudinal axis 20 abuts against one side of nut 19. A second sheath 56 also cylindrical in shape and concentric about longitudinal axis 20 surrounds first sheath 16 having an inside surface 57 in close proximity to the outside surface of first sheath 16. The left side of second sheath 56 abuts against sheath ring 60. Sheath ring 60 has inside threads 61 for threading onto corresponding outside threads of nut 19. The other end of second sheath 56 abuts against an annular ledge 58 of first sheath 16. Fuel tube 14 where it passes through support flange 12 and first sheath 16 may be concentric with longitudinal axis 20. Heat shield 22, may be cylindrical in shape and may extend from support flange 12 and enclose fuel tube 14 for a predetermined distance from support flange 12 to protect fuel tube 14 from excessive heat.

Figure 4:
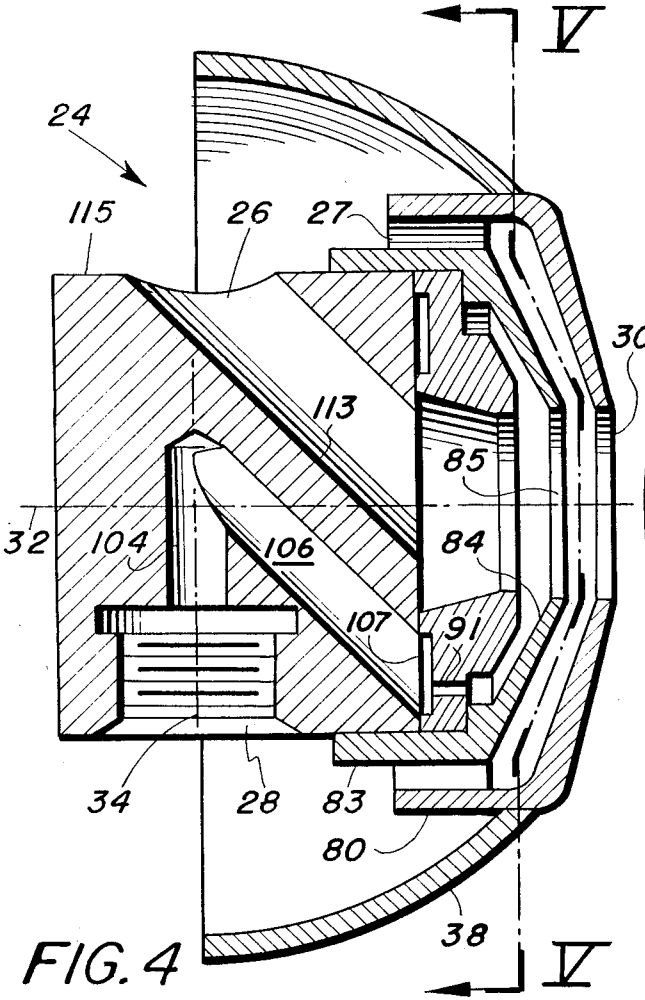
FIG. 4 is a cross section view along the lines IV—IV of FIG. 2.

A nozzle tip body 24, shown in more detail in FIGS. 2 and 4 through 6, is spaced a predetermined distance from support flange 12 and has an air inlet 26 shown in FIG. 4 and a fuel inlet 28. Nozzle tip body 24 has an outlet 30 for expelling atomized fuel outward from and along longitudinal axis 32 of nozzle tip body 24. Fuel inlet 28 is concentric with pivot axis 34 of nozzle tip body 24. Pivot axis 34 is positioned transverse to longitudinal axes 20 and 32. Fuel tube 14 extending from support flange 12 first follows along the longitudinal axis 20 and then is bent outwards off axis to allow its connection to one side of nozzle tip body 24. Fuel tube 14 is adjustably connected such as by a threaded jam nut 29 to fuel inlet 28 of nozzle body 24 to supply fuel to nozzle tip body 24. Fuel tube 14 also functions to support and hold nozzle tip body 24 and its longitudinal axis 32 at a first angle which is within a predetermined angular range, for example, from 45° to 80°. Angle $\phi$, is at 80°. The angle $\phi$, may be varied by loosening jam nut 29 and pivoting nozzle tip body 24 about pivot axis 34.

An internal air cap 38 is either mounted on pivot axis 34 or mounted on nozzle tip body 24 to direct air through nozzle tip body 24 by way of air inlets 26 and 27 as shown in FIG. 4. Internal air cap 38 has an outer surface with portions thereof conforming to the surface of a sphere to permit rotation of the internal air cap 38 about pivot axis 34 while maintaining a relatively small air gap with an external air cap 42. Internal air cap 38 may resemble a middle portion of a sphere when the sphere is intersected by two parallel planes.

Figure 2:
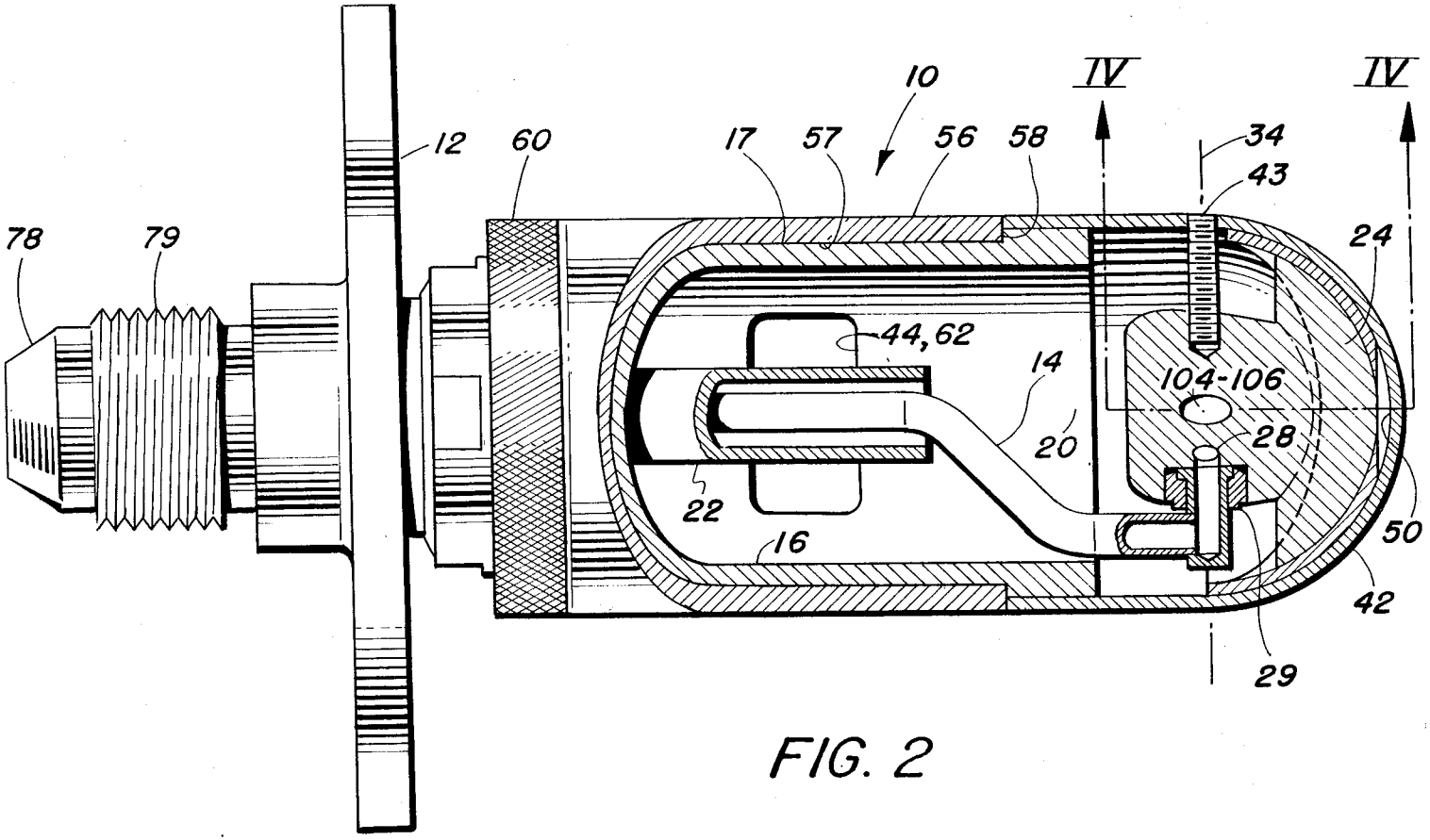
FIG. 2 is a cross section view along the lines II—II of FIG. 1.
Figure 6:
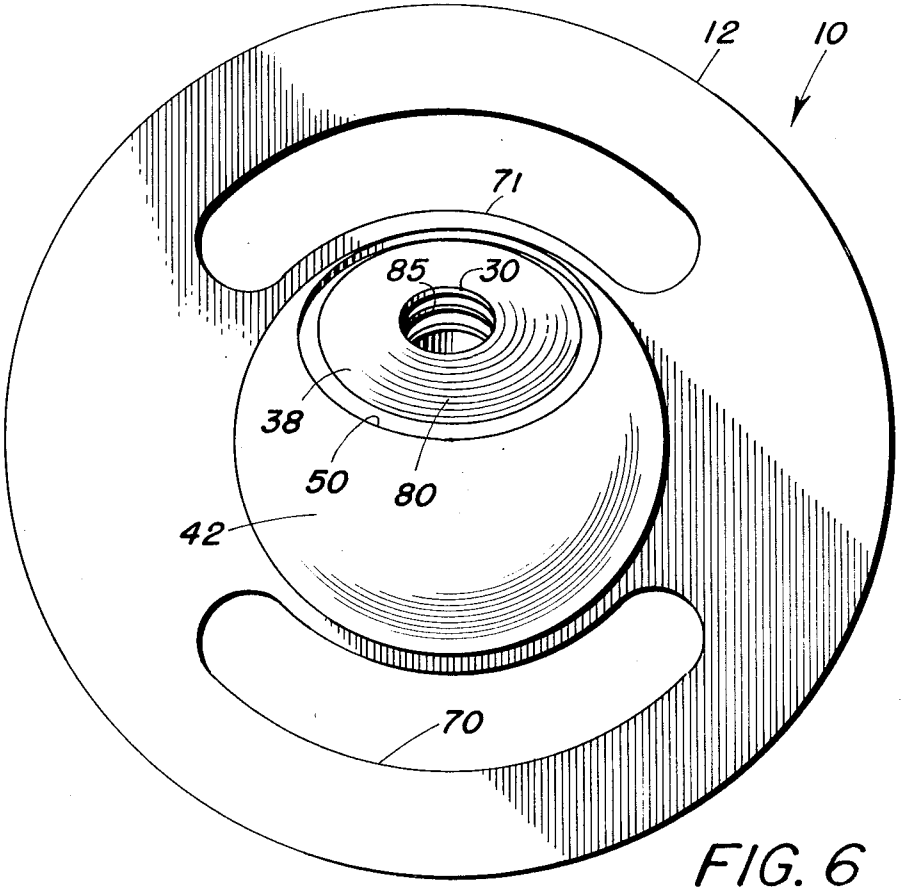
FIG. 6 is a front view of nozzle 10.

First sheath 16 may have a cylindrical shape concentric with longitudinal axis 20 and has a slot opening 44 for admitting air inside sheath 16. The slot may be formed at a predetermined distance from support flange 12. External air cap 42 has an inside surface 41 with portions thereof conforming to the surface of a sphere having a diameter equal to or larger than the outer surface portions 40 of internal air cap 38. Thus, internal air cap 38 is able to rotate smoothly with a small air gap inside of external air cap 42. External air cap 42 has an opening 46 which may be mated with or slide over the cylindrical end, opening 48, of sheath 16. External air cap 42 may be held in place by a set screw 43 shown in FIG. 2 aligned or concentric with pivot axis 34. Set screw 43 is threaded into nozzle tip body 24. The physical arrangement of openings 46 and 48 may allow external air cap 42 to slip or slide over the exterior surface of sheath 16 for a predetermined distance as shown in FIGS. 1 and 2.

External air cap 42 has a second opening 50 to expose outlet 30 of nozzle tip body 24 to permit nozzle tip body 24 to expel atomized fuel. Second opening 50 is enlarged to expose opening 30 of nozzle tip body 24 at various positions within a predetermined angular range $\phi$, for example, from 45° to 80° about pivot axis 34.

A second sheath 56 having a cylindrical inner surface 57 is concentric with longitudinal axis 20. The inner surface 57 of second sheath 56 has a diameter larger than the diameter of the outer surface 17 of first sheath 16 so that second sheath 56 may be moved with respect to first sheath 16 while being spaced close enough together to prevent loss of substantial quantities of air through the space between outer surface 17 and inner surface 57. First sheath 16 has an annular ledge 58 for holding second sheath 56 at a predetermined distance from support flange 12. A sheath ring 60 which may have inside threads 61 to match outside threads 61 on first sheath 16 holds second sheath 56 securely against annular ledge 58 when tightened.

Second sheath 56 has a slot opening 62 which is positioned to overlap with slot opening 44 to permit air to pass into sheath 16 and through nozzle tip body 24. Slot openings 44 and 62 may be positioned or rotated around longitudinal axis 20 by rotating first sheath 16 with respect to the support flange 12 by first loosening nut 19 by means of threads 18 to reduce the pressure on first sheath 16 between nut 19 and internal air cap 38.

After opening 44 has been positioned around longitudinal axis 20 and nut 19 tightened, second sheath 56 may be rotated with respect to first sheath 16 by loosening sheath ring 60. The size of openings 44 and 62 together may be adjusted by overlapping slot opening 62 with respect to slot opening 44 by rotating second sheath 56 around longitudinal axis 20. Sheath ring 60 may be retightened by means of threads 61 to hold second sheath 56 stationary with respect to first sheath 16 against annular ledge 58.

Figure 3:
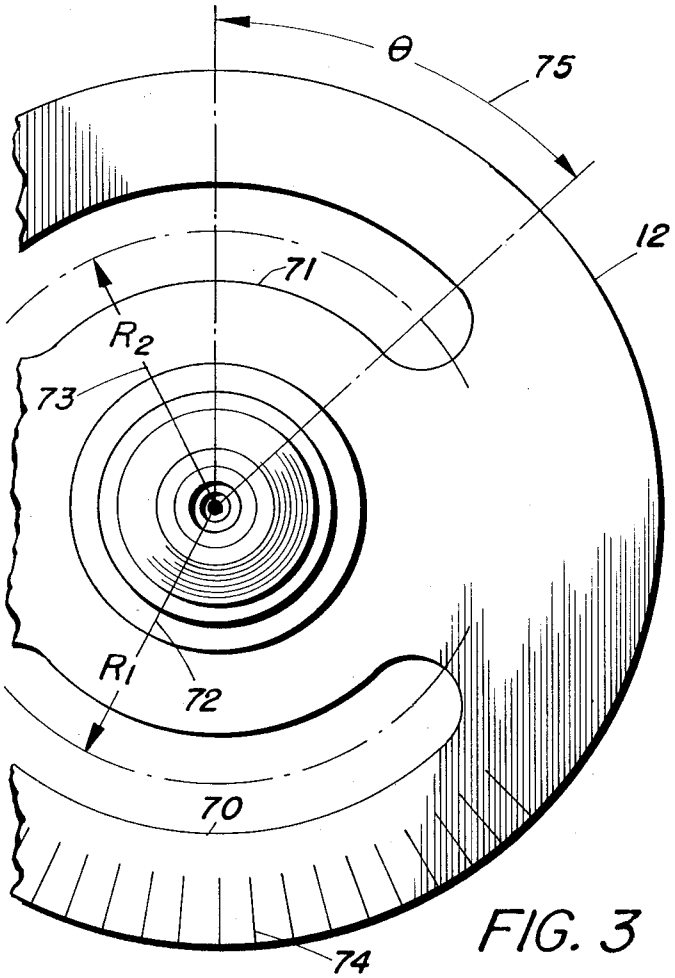
FIG. 3 is a side view of the embodiment in FIG. 1.

FIG. 3 is a side view of fuel nozzle 10 showing a plan view of support flange 12. Support flange 12 may be bolted to a support member (not shown) through slot openings 70 and 71. The center of slot openings 70 and 71 may be on a first and second radius, which may or may not be equal, shown by arrows 72 and 73, respectively, to permit rotation of support flange 12 with respect to a support member which may be held by bolts at a fixed position. In this manner, fuel nozzle 10 may be rotated around longitudinal axis 20 over a predetermined angular range, such as from 0° to 90° and fixedly attached to a support member by a bolt in slot openings 70 and 71. Surface scribe marks 74 may be positioned every 5° along slot opening 70 or 71 to define the angular position of fuel nozzle 10 with respect to a support member. It is noted that the fuel nozzle 10 may be rotated about its longitudinal axis 20 since the fuel fitting 78 including threads 79 on fuel nozzle 10 is concentric with longitudinal axis 20 and will enable the nozzle to rotate and use a press fit restrictor or metering orifice 76 and strainer 77.

Figure 5:
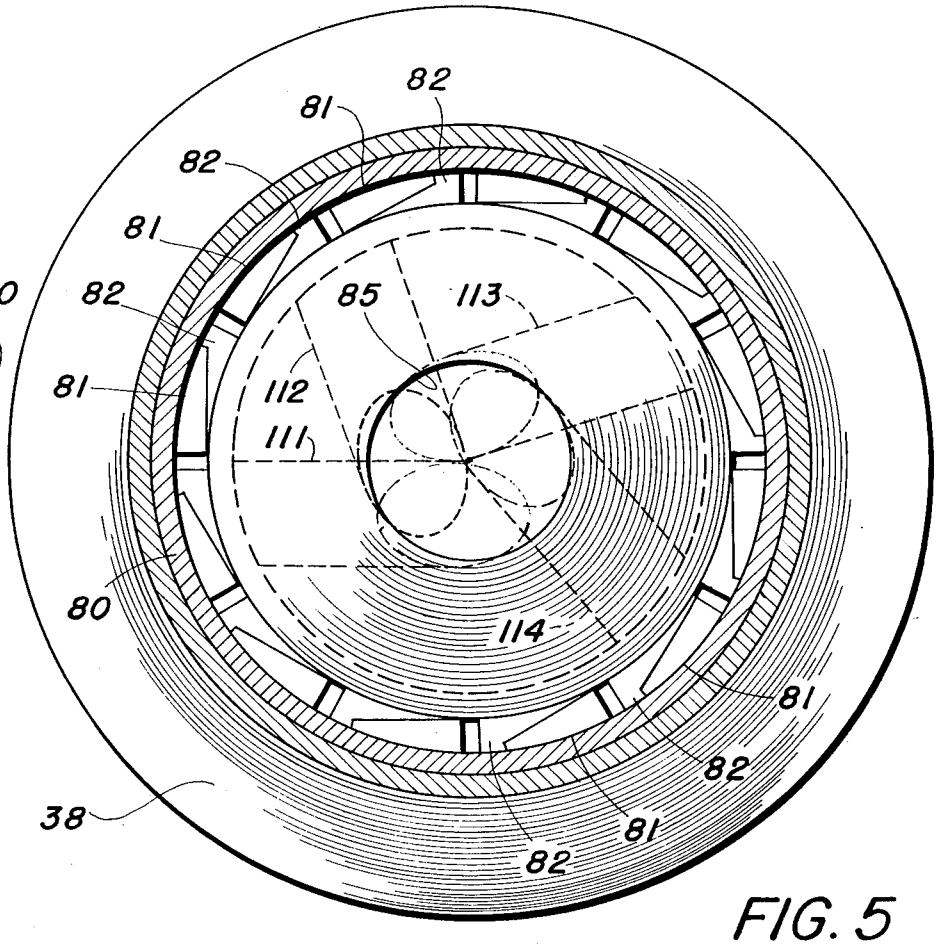
FIG. 5 is a front view of nozzle tip 24 in FIG. 4. showing air swirl passages.

FIG. 4 is a cross section view along the lines IV—IV of FIG. 2 which has been modified to show fuel inlet 28, channels 104 and 106 and hole 113. Fuel inlet 28 is shown in its true location in FIG. 2. Hole 113 is shown in its true location in FIG. 5. FIG. 5 is a front view of nozzle tip body 24 whown in FIG. 4 except internal air cap 38 and air shroud 80 have been removed. Nozzle tip body 24 as shown in FIG. 5 has vanes 81 and slots 82 for admitting air between air shroud 80 and lip 83 of nozzle tip body 24 which causes air to swirl up through slots 82 and inward toward longitudinal axis 32 in a counterclockwise direction when viewed from the downstream position. Fuel distribution holes 91 expel fuel in a forward direction onto surface 84 of lip 83 shown in FIG. 4. Fuel distribution holes 91 may be, for example, 0.5334 mm (0.021") diameter and may be four in number evenly spaced apart. Fuel inlet 28 couples fuel through channels 104 and 106 which delivers fuel to fuel distributor 107. Fuel distributor 107 is formed by an annular ring around and concentric with longitudinal axis 32 having a rectangular cross section. Fuel distribution holes 91 extend from fuel distributor 107 permitting fuel to travel from fuel inlet 28 through fuel distribution holes 91 onto surface 84 of lip 83.

Air from the compressor of a jet engine, for example, passes through slot openings 44 and 62 and flows through first sheath 16 to nozzle tip body 24. The air is split by nozzle tip body 24 with one portion of the air, for example, one half of the air being captured by four holes 111–114 of nozzle tip body 24. Holes 111–114 extend from side surface 115 of nozzle tip body 24 angularly by a compound angle to outlet 30 with the flow of air through holes 111–114 causing the air to swirl at outlet 30 in the counterclockwise direction along longitudinal axis 32 when viewed from the downstream position. Holes 111–114 form an angle with respect to longitudinal axis 32 in the plane of longitudinal axis 32 and a second angle with respect to a radial line in a plane orthogonal to longitudinal axis 32. Holes 111–114 have a diameter of 2.77 mm (0.109"). A second portion of compressed air, for example, one half of the amount of air passing through slot openings 44 and 62 passes through slots 82. Slots 82 may have a width of 2.54 mm (0.100").

In installation, fuel nozzle 10 is mounted on a wall of a combustor of an engine, for example, a turbo prop engine. A fuel manifold for distributing fuel to a number of fuel nozzles 10 in the combustor is coupled to fuel fitting 78 of each nozzle 10 for delivering fuel to its respective fuel tube 14. Fuel nozzle 10 may be attached to the wall of the combustor, for example, by bolts passing through slot openings 70 and 71 into mounting holes in the wall of the combustor. Fuel nozzle 10 may be rotated about axis 20 to, for example, an angle $\theta$ shown by arrow 75 in FIG. 3, by loosening the fuel manifold from fuel fitting 78 and the bolts in slot openings 70 and 71 of support flange 12. After orienting fuel nozzle 10 to the desired angular position, as may be indicated by scribe mark 74 with respect to an orientation mark on the wall of the combustor or by the bolt position in the slot openings, the bolts in slot openings 70 and 71 may be tightened to secure the angular position $\theta$ of fuel nozzle 10 about axis 20 with respect to the wall of the combustor or by the bolt position in the slot openings. The fuel manifold may then be refastened or tightened to fuel fitting 78. Fuel fitting 78 may be brazed to support flange 12.

The fuel injection angle $\phi$, shown in FIG. 1, may be adjusted by removing the external air cap 42 which may be held in place by a threaded set screw 43 shown in FIG. 2. With set screw 43 removed, the external air cap 42 may be slid off first sheath 16 to expose the internal air cap 38, nozzle tip body 24 and fuel tube 14. Jam nut 29 holding fuel tube 14 to nozzle tip body 24 may be loosened, such as with the aid of needle nose pliers or a wrench, and the nozzle tip body 24 may be rotated to a desired angle $\phi$ which may be, for example, in the range from 45°–80°. It is noted that the internal air cap 38 also rotates with the nozzle tip body 24 to insure that compressor air in first sheath 16 is always directed toward the nozzle tip body 24. With the proper fuel injection angle $\phi$, of nozzle tip body 24, the loosened jam nut 29 on fuel tube 14 is retightened to hold nozzle tip body 24 at the selected angle. Leak tight joints between fuel tube 14 and nozzle tip body 24 may be accomplished by mate lapping. The external air cap 42 is slid back over first sheath 16 and secured by set screw 43 which is threaded into nozzle tip body 24.

In operation of fuel nozzle 10, fuel tube 14 supplies, for example, jet fuel oil, to fuel inlet 28 which then flows through channels 104 and 106 to fuel distributor 107. From fuel distributor 107 fuel flows through fuel distribution holes 91 whereupon the fuel is released onto surface 84 of lip 83. The fuel is atomized as it leaves surface 84 and lip 83 by swirling air from holes 111–114 and from slots 82 via air shroud 80. The swirling atomized air exits outlet 30 in the counterclockwise direction when viewed from the downstream position of nozzle tip body 24.

Air in first sheath 16 is directed through nozzle tip body 24 by internal air cap 38. External air cap 42 prevents air in first sheath 16 from escaping in substantial amounts between internal air cap 38 and first sheath 16. Internal air cap 38 and external air cap 42 have mating surfaces of revolution , for example, spherical surface portions which enable internal air cap 38 to revolve about pivot axis 34 with respect to external air cap 42. The space between internal air cap 38 and external air cap 42 is sufficient to allow movement of one with respect to the other while the space is small enough to prevent substantial loss of air from sheath 16. Thus, substantially all of the air in sheath 16 is directed by internal air cap 38 to nozzle tip body 24. The air from first sheath 16 is split by nozzle tip body 24 with a first portion, for example, 50% captured by air inlet 26 through holes 111–114 which expel the air at outlet 30 in a counterclockwise direction around longitudinal axis 32 when viewed from the downstream position. A second portion of air from first sheath 16, or the remaining balance of air, is externally spun by slots 82. The air in slots 82 is spun in a counterclockwise direction when viewed from the downstream position about longitudinal axis 32 and enters outlet 30 from a radius greater than outlet 30 from between lip 83 and air shroud 80. The fuel from fuel distribution holes 91 is atomized by the swirling air from holes 111–114 and slots 82.

The amount of air, for example, from a compressor of an engine, entering first sheath 16 may be controlled by adjusting the overlap of slot openings 44 and 62. Second sheath 56 may be rotated with respect to first sheath 16 by loosening sheath ring 60. Sheath ring 60 may be retightened to hold second sheath 56 in its position after rotating second sheath 56 with respect to first sheath 16 to adjust the size of the opening due to overlapping slot openings 44 and 62. Slot openings 44 and 62 may each be, for example, 6.35 mm (0.250″) along the surface in the plane normal to axis 20 of first and second sheaths 16 and 56, respectively, by 4.064 mm (0.160″) wide which may be, for example, in a direction parallel to longtiudinal axis 20. The outside diameter of second sheath 56 may be, for example, 23.216 mm (0.914″).

A fuel nozzle 10 for atomizing fuel in air and for injecting the fuel and air into an air stream at a first angle $\phi$, with respect to a first longitudinal axis 20 wherein angle $\phi$, is adjustable over a predetermined angular range from 45° to 80°, for example, has been described comprising a support flange 12 for mechanically supporting a fuel tube 14 and nut 19, a first sheath 16, a nozzle tip body 24 spaced a predetermined distance from support flange 12 and having an air inlet 26, 27 and a fuel inlet 28 and an outlet 30 for expelling atomized fuel outward from and along the second longitudinal axis 32 of the nozzle tip body 24, the fuel inlet 28 being concentric with a pivot axis 34 of nozzle tip body 24, the nozzle tip pivot axis 34 positioned transverse to the first and second longitudinal axes 20, 32, the fuel supply tube 14 having a first end adjustably connected to the fuel inlet 28 of nozzle tip body 24 to supply fuel thereto and to support and hold nozzle tip body 24 with its second longitudinal axis 32 at the first angle $\phi$, by positioning the nozzle tip body 24, the first longitudinal axis 20 passing through the support flange 12 and through the nozzle tip body 24, an internal air cap 38 having an outer surface with portions 40 thereof conforming to a first surface of revolution, for example, a sphere surrounding nozzle tip body 24 and attached thereto to direct air through the nozzle tip body via air inlets 26 and 27, the first sheath 16 having a cylindrical shape concentric with the first longitudinal axis 20, having a slot opening 44 for admitting air inside sheath 16, sheath 16 extending a predetermined distance from support flange 12, an external air cap 42 having an inside surface 41 with portions thereof conforming to the first surface of revolution, for example, a spherical surface and having a first opening 46 for mating with an opening 48 at the end of sheath 16 and a second opening 50 to permit the nozzle tip body 24 to expel atomized fuel at positions about pivot axis 34 within the predetermined angular range.

Further, an apparatus for adjusting the position and size of an air inlet to a fuel nozzle has been described comprising a first sheath 16 having a cylindrical outer surface of a first diameter concentric with a first axis 20, a second sheath 56 having an inner surface 57 of a second diameter concentric with first axis 20, the second diameter being greater than the first diameter, a first opening 44 formed in first sheath 16, a second slot opening 62 formed in second sheath 56, a support flange 12 and nut 19 having threads 18 for rotating first sheath 16 and second sheath 56 around axis 20 to a first position and for securing, to position opening 44 of first sheath 16, sheath ring 60 having threads 61 for rotating second sheath 56 with respect to first sheath 16 to adjust the size of the opening formed by the overlap of slot openings 44 and 62, and a nozzle tip body 24 positioned at the end of first sheath 16 to receive the air passing through overlap slot openings 44 and 62.

The invention claimed is:

1. An apparatus for atomizing fuel in air and for injecting said fuel and air into an air stream at a first angle $\phi$ with respect to a first longitudinal axis which is adjustable over a predetermined angular range comprising:

a support flange for mechanically supporting a fuel supply tube and a first sheath, a nozzle tip body spaced a predetermined distance from said support flange and having an air inlet and a fuel inlet and an outlet for expelling atomized fuel outward from and along a second longitudinal axis of said nozzle tip body, said fuel inlet concentric with a pivot axis of said nozzle tip body, said nozzle tip body pivot axis positioned transverse to said first and second longitudinal axes, said fuel supply tube having a first end adjustably connected to said fuel inlet of said nozzle tip body to supply fuel thereto and to support and hold said nozzle tip body with its second longitudinal axis at said angle within said predetermined angular range by positioning said nozzle tip body around said pivot axis, said first longitudinal axis passing through said support flange and through said nozzle tip body, an internal air cap having an outer surface with portions thereof conforming to the surface of revolution, said outer surface surrounding said nozzle tip body and attached thereto to direct air through said nozzle tip body via said air inlet, said first sheath having a cylindrical shape concentric with said first longitudinal axis, having a slot opening for admitting air inside said sheath, said sheath extending a predetermined distance from said support flange, an external air cap having an inside surface with portions thereof conforming to the surface of revolution and having a first opening for mating with an opening at the end of said sheath and a second opening to permit said nozzle tip body to expel atomized fuel at positions within said predetermined angular range about said pivot axis.

2. The apparatus of claim 1 wherein said support flange has at least one slot opening to permit rotation of said support flange with respect to a support member secured by a bolt.

3. The apparatus of claim 2 wherein said slot opening in said support flange has a center line at a predetermined distance from said first longitudinal axis.

4. The apparatus of claim 3 wherein said slot opening extends at least 45° around said first longitudinal axis.

5. The apparatus of claim 1 wherein said first end of said fuel supply tube includes a jam nut.

6. The apparatus of claim 1 wherein said predetermined angular range of angle $\phi$ extends from 45° to 80°.

7. The apparatus of claim 1 wherein said external air cap has its first opening mating with an opening of the end of said sheath to prevent air from escaping therebetween.

8. The apparatus of claim 1 wherein said portions of said inside surface of said external air cap are spaced less than a predetermined distance to said portions of said outer surface of said internal air cap to prevent the escape of air from within said sheath between said external air cap and said internal air cap at positions of said nozzle tip body within said predetermined angular range.

9. The apparatus of claim 1 wherein said surface portions conforming to the surface of revolution are spherical.

10. The apparatus of claim 1 wherein said second opening of said external air cap includes a slot opening having a center line at a predetermined distance from said pivot axis wherein said center line is in a plane normal to said pivot axis.

11. The apparatus of claim 1 wherein said external air cap further includes a set screw passing into said nozzle tip body.

12. The apparatus of claim 11 wherein said set screw passes into said nozzle body along said pivot axis.

13. The apparatus of claim 1 wherein said first sheath is surrounded by a second sheat concentric with said first longitudinal axis having a slot opening for admitting air inside said first and second sheaths at times said slot opening of said second sheath overlaps said slot opening of said first sheath.

14. The apparatus of claim 13 wherein said second sheath is cylindrical in shape and wherein said first sheath has an annular ledge for positioning said second sheath in the longitudinal direction.

15. The apparatus of claim 14 wherein said support flange includes a threaded surface concentric with said first axis for receiving a nut thereon, said nut having a cylindrical outside surface concentric with said first axis having portions closest said support flange with threads thereon, an outer sheath ring having inside threads for threading onto corresponding outside threads of said nut for compressing said second sheath between said outer sheath ring and said anular ledge whereby said second sheath may be rotated about said first longitudinal axis to provide a predetermined overlap between corresponding slot openings in said first and second sheaths.

16. The apparatus of claim 1 wherein said support flange further includes a threaded surface concentric with said first axis for receiving a nut thereon, said nut having a cylindrical surface concentric with said first axis for receiving the cylindrical inner surface of said second sheath wherein said first sheath is positioned by said second sheath concentric with said first axis and wherein said first sheath has a second end which abuts against said internal air cap.

* * * * *